US006247896B1

(12) United States Patent
Auxier et al.

(10) Patent No.: US 6,247,896 B1
(45) Date of Patent: Jun. 19, 2001

(54) METHOD AND APPARATUS FOR COOLING AN AIRFOIL

(75) Inventors: Thomas A. Auxier, Palm Beach Gardens; James P. Downs, Jupiter, both of FL (US); William S. Kvasnak, Guilford, CT (US); Friedrich O. Soechting, Tequesta, FL (US); William H. Calhoun, Akworth, GA (US); Douglas A. Hayes, Port St. Lucie, FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/338,376

(22) Filed: Jun. 23, 1999

(51) Int. Cl.[7] ..... F01D 5/18
(52) U.S. Cl. ..... 416/97 R
(58) Field of Search ..... 415/115, 176, 415/178; 416/96 R, 97 R

(56) References Cited

U.S. PATENT DOCUMENTS

| | | | | |
|---|---|---|---|---|
| 4,293,275 | * | 10/1981 | Kobayashi et al. | 416/97 R |
| 4,314,442 | | 2/1982 | Rice | 60/39.05 |
| 4,653,983 | | 3/1987 | Vehr | 416/97 R |
| 4,664,597 | | 5/1987 | Auxier et al. | 416/97 R |
| 4,669,957 | | 6/1987 | Phillips et al. | 416/97 R |
| 4,676,719 | | 6/1987 | Auxier et al. | 416/97 R |
| 4,726,735 | | 2/1988 | Field et al. | 416/97 R |
| 5,342,172 | | 8/1994 | Coudray et al. | 416/97 R |
| 5,392,515 | | 2/1995 | Auxier et al. | 29/889.721 |
| 5,405,242 | | 4/1995 | Auxier et al. | 415/115 |
| 5,419,039 | | 5/1995 | Auxier et al. | 29/889.721 |
| 5,419,681 | | 5/1995 | Lee | 416/97 R |
| 5,458,461 | | 10/1995 | Lee et al. | 416/97 R |
| 5,626,462 | | 5/1997 | Jackson et al. | 416/97 R |
| 5,639,216 | * | 6/1997 | McLaurin et al. | 416/95 |
| 5,848,876 | * | 12/1998 | Tomita | 416/96 R |
| 6,017,189 | * | 1/2000 | Judet et al. | 416/97 R |
| 6,065,931 | * | 5/2000 | Suenaga et al. | 416/97 R |
| 6,071,075 | * | 6/2000 | Tomita et al. | 416/97 R |

* cited by examiner

*Primary Examiner*—Edward K. Look
*Assistant Examiner*—Ninh Nguyen
(74) *Attorney, Agent, or Firm*—Richard D. Getz

(57) ABSTRACT

A method and apparatus for cooling a wall within a gas turbine engine is provided which comprises the steps of: (1) providing a wall having an internal surface and an external surface; (2) providing a cooling microcircuit within the wall that has a passage for cooling air that extends between the internal surface and the external surface; and (3) increasing heat transfer from the wall to a fluid flow within the passage by increasing the average heat transfer coefficient per unit flow within the microcircuit. According to one aspect, the present invention method and apparatus can be tuned to substantially match the thermal profile of the wall at hand.

24 Claims, 3 Drawing Sheets

METHOD AND APPARATUS FOR COOLING AN AIRFOIL

BACKGROUND OF THE INVENTION

1. Technical Field

This invention relates to gas turbine engines in general, and to methods and apparatus for cooling a rotor blade or stator vane in particular.

2. Background Information

Efficiency is a primary concern in the design of any gas turbine engine. Historically, one of the principle techniques for increasing efficiency has been to increase the gas path temperatures within the engine. The increased temperatures have been accommodated by using internally cooled components made from high temperature capacity alloys. Turbine stator vanes and blades, for example, are typically cooled using compressor air worked to a higher pressure, but still at a lower temperature than that of the core gas flow passing by blade or vane. The higher pressure provides the energy necessary to push the air through the component. A significant percentage of the work imparted to the air bled from the compressor, however, is lost during the cooling process. The lost work does not add to the thrust of the engine and therefore negatively effects the overall efficiency of the engine. A person of skill in the art will recognize, therefore, that there is a tension between the efficiency gained from higher core gas path temperatures and the concomitant need to cool turbine components and the efficiency lost from bleeding air to perform that cooling.

There is, accordingly, great value in maximizing the cooling effectiveness of whatever cooling air is used. Prior art coolable airfoils typically include a plurality of internal cavities, which are supplied with cooling air. The cooling air passes through the wall of the airfoil (or the platform) and transfers thermal energy away from the airfoil in the process. The manner in which the cooling air passes through the airfoil wall is critical to the efficiency of the process. In some instances, cooling air is passed through straight or diffused cooling apertures to convectively cool the wall and establish an external film of cooling air. A minimal pressure drop is typically required across these type cooling apertures to minimize the amount of cooling air that is immediately lost to the free-stream hot core gas passing by the airfoil. The minimal pressure drop is usually produced through a plurality of cavities within the airfoil connected by a plurality of metering holes. Too small a pressure drop across the airfoil wall can result in undesirable hot core gas in-flow. In all cases, the minimal dwell time in the cooling aperture as well as the size of the cooling aperture make this type of convective cooling relatively inefficient.

Some airfoils convectively cool by passing cooling air through passages disposed within a wall or platform. Typically, those passages extend a significant distance within the wall or platform. There are several potential problems with this type of cooling scheme. First, the heat transfer rate between the passage walls and the cooling air decreases markedly as a function of distance traveled within the passage. As a result, cooling air flow adequately cooling the beginning of the passage may not adequately cool the end of the passage. If the cooling air flow is increased to provide adequate cooling at the end of the passage, the beginning of the passage may be excessively cooled, consequently wasting cooling air. Second, the thermal profile of an airfoil is typically non-uniform and will contain regions exposed to a greater or lesser thermal load. The prior art internal cooling passages extending a significant distance within an airfoil wall or a platform typically span one or more regions having disparate thermal loads. Similar to the situation described above, providing a cooling flow adequate to cool the region with the greatest thermal load can result in other regions along the passage being excessively cooled.

What is needed, therefore, is a method and apparatus for cooling a substrate within gas turbine engine that adequately cools the substrate using a minimal amount of cooling air and one that provides heat transfer where it is needed.

DISCLOSURE OF THE INVENTION

It is, therefore, an object of the present invention to provide a method and an apparatus for cooling a wall within a gas turbine engine that uses less cooling air than conventional cooling methods and apparatus.

It is another object to provide a method and an apparatus for cooling a wall within a gas turbine engine that removes more cooling potential from cooling air passed through the wall than is removed in conventional cooling methods and apparatus.

It is another object to provide a method and an apparatus for cooling a wall within a gas turbine engine that is able to provide a cooling profile that substantially matches the thermal profile of the wall. In other words, a cooling method and apparatus that can be tuned to offset the thermal profile at hand and thereby decrease excessive cooling.

According to the present invention, a method and apparatus for cooling a wall within a gas turbine engine is provided which comprises the steps of (1) providing a wall having an internal surface and an external surface; (2) providing a cooling microcircuit within the wall that has a passage for cooling air that extends between the internal surface and the external surface; and (3) increasing heat transfer from the wall to a fluid flow within the passage by increasing the average heat transfer coefficient per unit flow within the microcircuit.

According to an aspect of the present invention, a method and apparatus for cooling a wall is provided which can be tuned to substantially match the thermal profile of the wall at hand. Specifically, the present invention microcircuits can be tailored to provide a particular amount of cooling at a particular location within a wall commensurate with the thermal load at that particular location.

According to another aspect of the present invention, a cooling microcircuit for cooling within a wall is provided which includes a plurality of passage segments connected by turns. The short length of each passage segment provides a higher average heat transfer coefficient per unit flow than is available in the prior art under similar operating conditions (e.g., pressure, temperature, etc.)

According to another aspect of the present invention, a cooling microcircuit is provided in a wall that includes a plurality of passage segments connected in series by a plurality of turns. Each successive passage segment decreases in length.

The present invention cooling microcircuits provide significantly increased cooling effectiveness over prior art cooling schemes. One of the ways the present invention microcircuit provides increased cooling effectiveness is by increasing the heat transfer coefficient per unit flow within a cooling passage. The transfer of thermal energy between the passage wall and the cooling air is directly related to the heat transfer coefficient within the passage for a given flow. A velocity profile of fluid flow adjacent each wall of a passage is characterized by an initial hydrodynamic entrance region and a subsequent fully developed region as can be seen in FIG. 6. In the entrance region, a fluid flow boundary layer develops adjacent the walls of the passage, starting at zero thickness at the passage entrance and eventually becoming a constant thickness at some position downstream within the passage. The change to constant thickness marks the beginning of the fully developed flow region. The heat transfer coefficient is at a maximum when the boundary layer thickness is equal to zero, decays as the boundary layer thickness increases, and becomes constant when the boundary layer becomes constant. Hence, for a given flow the average heat transfer coefficient in the entrance region is higher than the heat transfer coefficient in the fully developed region. The present invention microcircuits increase the percentage of flow in a passage characterized by entrance region effects by providing a plurality of short passage segments connected by turns. Each time the fluid within the passage encounters a turn, the velocity profile of the fluid flow exiting that turn is characterized by entrance region effects and consequent increased local heat transfer coefficients. The average heat transfer coefficient per unit flow of the relatively short passage segments of the present invention microcircuit is consequently higher than that available in all similar prior art cooling schemes of which we are aware.

A second way the present invention microcircuits increase the average heat transfer coefficient per unit flow is by decreasing the cross-sectional area of the passage and increasing the perimeter of the passage. If the following known equation is used to represent the heat transfer coefficient:

$$h_c = \frac{k}{D_H} 0.023 \left(\frac{\rho U D_H}{\mu}\right)^{0.8} P_R^{0.4} \qquad \text{(Eqn. 1)}$$

The following equation can be derived which illustrates the relationship between the heat transfer coefficient ($h_c$), the passage perimeter (P), and the cross-sectional area (A) of the passage (where C=constant and W=fluid flow):

$$h_c = \frac{P^{0.2} W^{0.8}}{A} C \qquad \text{(Eqn. 2)}$$

Namely, that an increase in the cross-sectional area of the passage will decrease the heat transfer coefficient, and an increase in the perimeter of the passage will increase the heat transfer coefficient. The present invention microcircuits utilize passages having a smaller cross-sectional area and a larger perimeter when compared to conventional cooling schemes of which we are aware. The resultant cooling passage has a greater heat transfer coefficient per unit flow and consequent greater rate of heat transfer.

Another way the present invention provides an increased cooling effectiveness involves using a short length passage segment between turns. The relationship between the heat transfer rate and the heat transfer coefficient in given length of passage can be mathematically described as follows:

$$q = h_c A_s \Delta T_{1m} \qquad \text{(Eqn.3)}$$

where:

q=heat transfer rate between the passage and the fluid $h_c$=heat transfer coefficient of the passage $A_s$=passage surface area=P×L=Passage perimeter x length $\Delta T_{1m}$=log mean temperature difference The above equation illustrates the direct relationship between the heat transfer rate and the heat transfer coefficient, as well the relationship between the heat transfer rate and the difference in temperature between the passage surface temperature and the inlet and exit fluid temperatures passing through a length of passage (i.e., $\Delta T_{1m}$). In particular, if the passage surface temperature is held constant (a reasonable assumption for a given length of passage within an airfoil, for example) the temperature difference between the passage surface and the fluid decays exponentially as a function of distance traveled through the passage. The consequent exponential decay of the heat transfer rate is particularly significant in the fully developed region where the heat transfer coefficient is constant and the heat transfer rate is dependent on the difference in temperature. The present invention microcircuits use relatively short length passage segments disposed between turns. As stated above, a portion of each segment is characterized by an entrance region velocity profile and the remainder is characterized by a fully developed velocity profile. In all embodiments of the present invention microcircuits, the passage segment length between turns is short to minimize the effect of the exponentially decaying heat transfer rate attributable to temperature difference, particularly in the fully developed region.

In some embodiments of the present invention, the microcircuit includes a number of passage segments successively shorter in length. The longest of the successively shorter passage segments is positioned adjacent the inlet of the microcircuit where the temperature difference between the fluid temperature and the passage wall is greatest, and the shortest of the successively shorter passage segments is positioned adjacent the exit of the microcircuit where the temperature difference between the fluid temperature and the passage wall is smallest. Successively decreasing the length of the passage segments within the microcircuit helps to offset the decrease in $\Delta T_{1m}$ in each successive passage. For explanation sake, consider a plurality of same length passage segments, connected to one another in series. The average $\Delta T_{1m}$ of each successive passage segment will decrease because the cooling air increases in temperature as it travels through each passage segment. The average heat transfer rate, which is directly related to the $\Delta T_{1m}$, consequently decreases in each successive passage segment. Cooling air traveling through a plurality of successively shorter passage segments will also increase in temperature passing through successive passage segments. The amount that the $\Delta T_{1m}$ decreases per passage segment, however, is less in successively shorter passage segments (vs. equal length segments) because the length of the passage segment where the exponential temperature decay occurs is shorter. Hence, decreasing passage segment lengths positively influence the heat transfer rate by decreasing the influence of the exponential decaying temperature difference.

The heat transfer rate can also be positively influenced by manipulating the average per length heat transfer coefficient of each passage segment. Consider that the average heat transfer coefficient within each entrance region is always greater than the heat transfer coefficient within the downstream fully developed region. Consider further that any technique that positively influences the average heat transfer coefficient within a passage segment will also positively influence the heat transfer rate within that passage segment. The progressively decreasing passage length embodiment of the present microcircuit, positively influences the average heat transfer coefficient by having a greater portion of each progressively shorter passage segment devoted to entrance region effects and the higher average heat transfer coefficient associated therewith. The positively influenced heat transfer coefficient in each progressively shorter passage segment offsets the decreasing $\Delta T_{1m}$ (albeit a smaller $\Delta T_{1m}$ because of the successively shorter passage segment lengths) and thereby positively influences the cooling effectiveness of the passage segment.

Another way the present invention microcircuit provides an increased cooling effectiveness is by utilizing the pressure difference across the wall in a manner that optimizes heat transfer within the microcircuit. Convective heat transfer is a function of the Reynolds number and therefore the Mach number of the cooling airflow traveling within the microcircuit. The Mach number, in turn, is a function of the cooling airflow velocity within the microcircuit. The pressure difference across the microcircuit can be adjusted, for example, by changing the number of passages and turns within the microcircuit. In all applications, the present invention microcircuits are optimized to use substantially all of the pressure drop across the microcircuit since that pressure drop provides the energy necessary to remove the cooling potential from the cooling air. Specifically, the method for optimizing the heat transfer via the pressure difference across the microcircuit begins with a given pressure difference across the wall, a desired pressure difference across the exit aperture of the microcircuit, and a known core gas pressure adjacent the microcircuit exit aperture (i.e., the local external pressure). Given the local external pressure and the desired pressure difference across the exit aperture, the pressure of the cooling air within the microcircuit adjacent the exit aperture can be determined. Next, a difference in pressure across the microcircuit is chosen which provides optimal heat transfer for a given passage geometry, cooling air mass flow, and airflow velocity, all of which will likely depend on the application at hand. As stated above, the pressure difference across the microcircuit can be adjusted by changing the number and characteristics of the passages and turns. Given the desired pressure difference across the microcircuit, the inlet aperture is sized to provide the necessary pressure inside the microcircuit adjacent the inlet aperture to accomplish the desired pressure difference across the microcircuit.

The small size of the present microcircuit also provides advantages over many prior art cooling schemes. The thermal profile of most blades or vanes is typically non-uniform along its span and/or width. If the thermal profile is reduced to a plurality of regions however, and if the regions are small enough, each region can be considered as having a uniform heat flux. The non-uniform profile can, therefore, be described as a plurality of regions, each having a uniform heat flux albeit different in magnitude. The size of each present invention microcircuit is likely small enough such that it can occupy one of those uniform regions. Consequently, the microcircuit can be "tuned" to provide the amount of cooling necessary to offset that heat flux in that particular region. A blade or vane having a non-uniform thermal profile can be efficiently cooled with the present invention by positioning a microcircuit at each thermal load location, and matching the cooling capacity of the microcircuit to the local thermal load. Hence, excessive cooling is decreased and the cooling effectiveness is increased.

The size of the present microcircuits also provides cooling passage compartmentalization. Some conventional cooling passages include a long passage volume connected to the core gas side of the substrate by a plurality of exit apertures. In the event a section of the passage is burned through, it is possible for a significant portion of the passage to be exposed to hot core gas in-flow through the plurality of exit apertures. The present microcircuits limit the potential for hot core gas in-flow by preferably utilizing only one exit aperture. In the event hot core gas in-flow does occur, the present microcircuits are limited in area, consequently limiting the area potentially exposed to undesirable hot core gas.

These and other objects, features and advantages of the present invention will become apparent in light of the detailed description of the best mode embodiment thereof, as illustrated in the accompanying drawings.

DETAILED DESCRIPTION OF THE INVENTION

Figure 1:
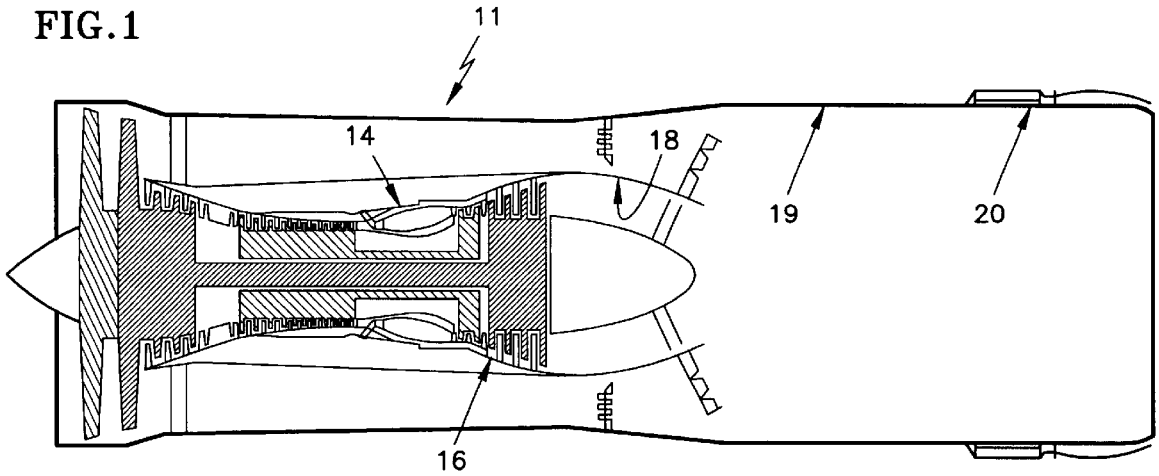
FIG. 1 is a diagrammatic view of a gas turbine engine.
Figure 2:
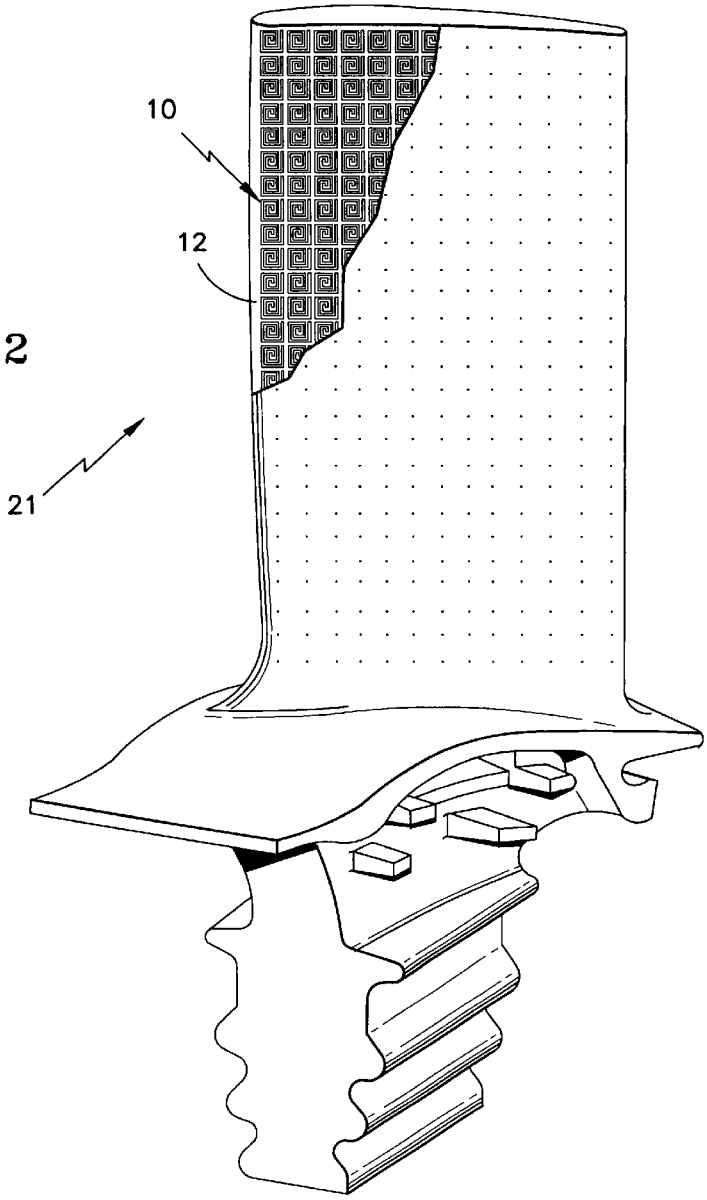
FIG. 2 is a diagrammatic view of a rotor blade having a plurality of the present invention microcircuits disposed in a wall.
Figure 3:
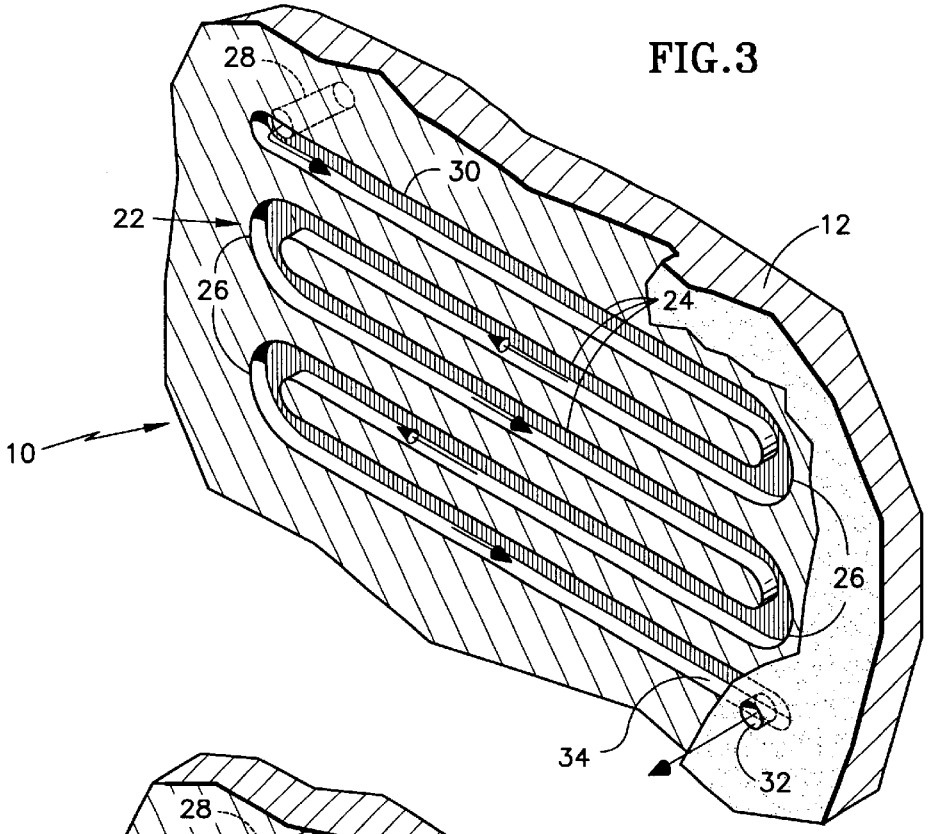
FIG. 3 is an enlarged diagrammatic view of an embodiment of the present invention microcircuit.
Figure 4:
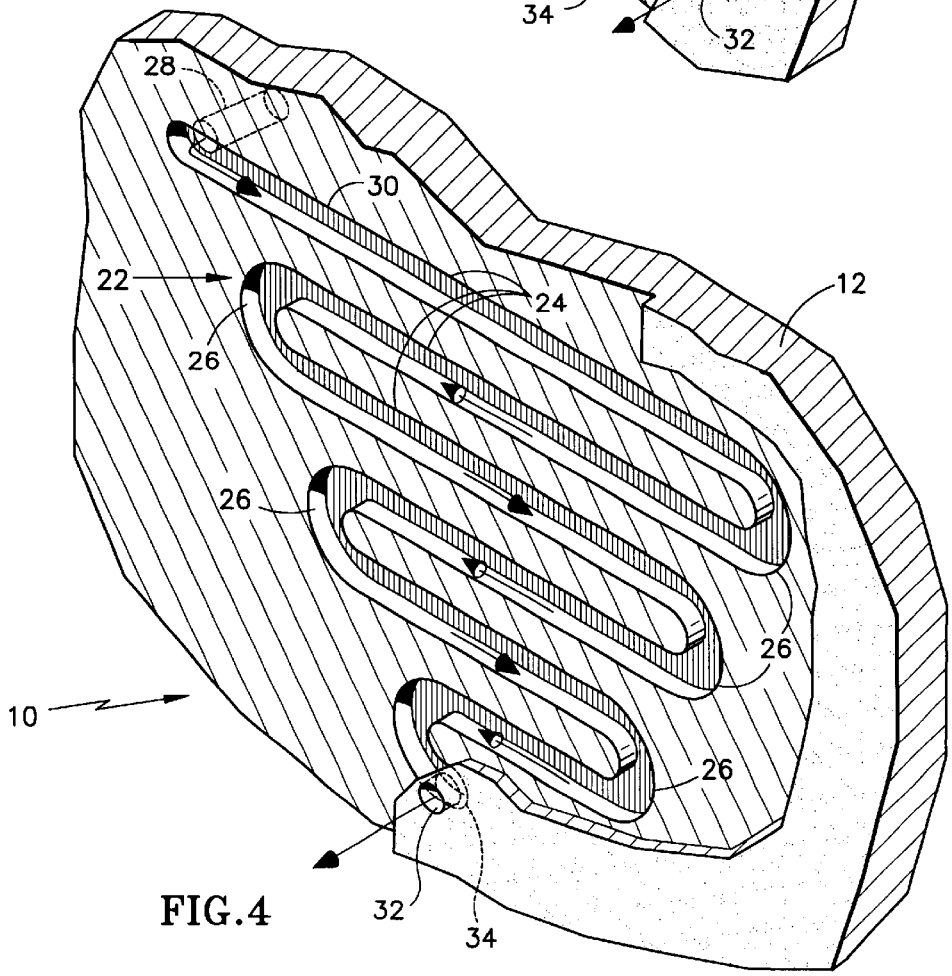
FIG. 4 is a large scale diagrammatic view of an embodiment of the present invention microcircuit having successive passage segments that decrease in length.
Figure 5:
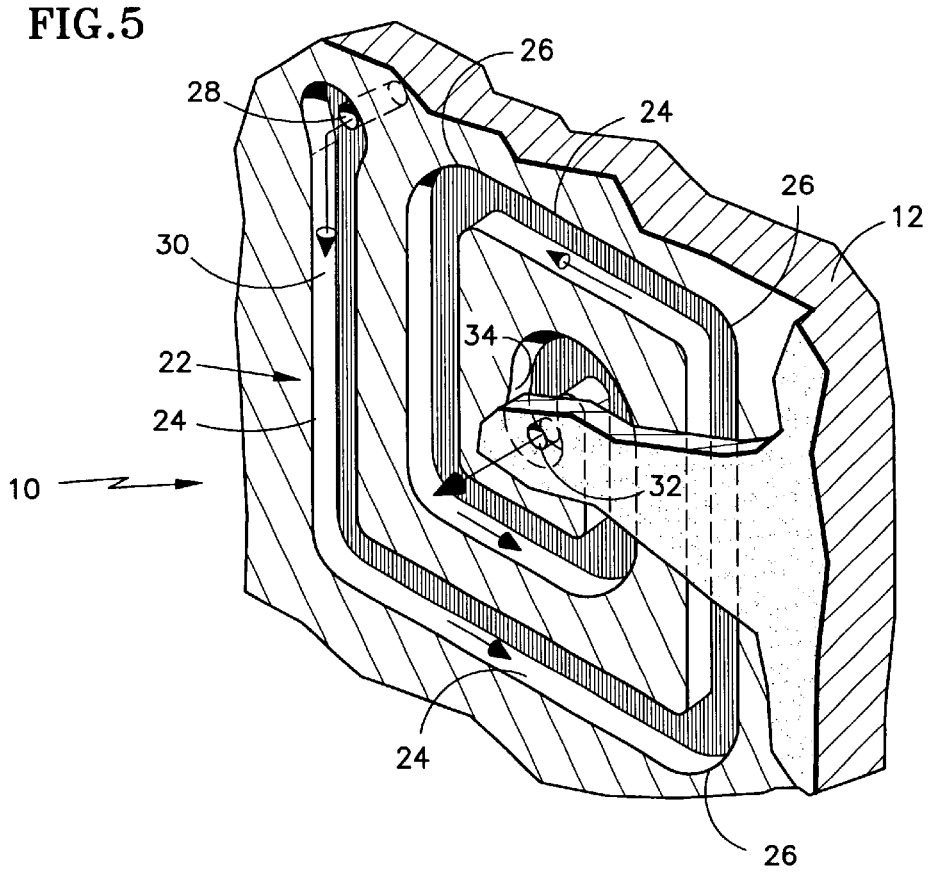
FIG. 5 is a large scale diagrammatic view of an embodiment of the present invention microcircuit spiraling inwardly and having passage segments that decrease in length.
Figure 6:
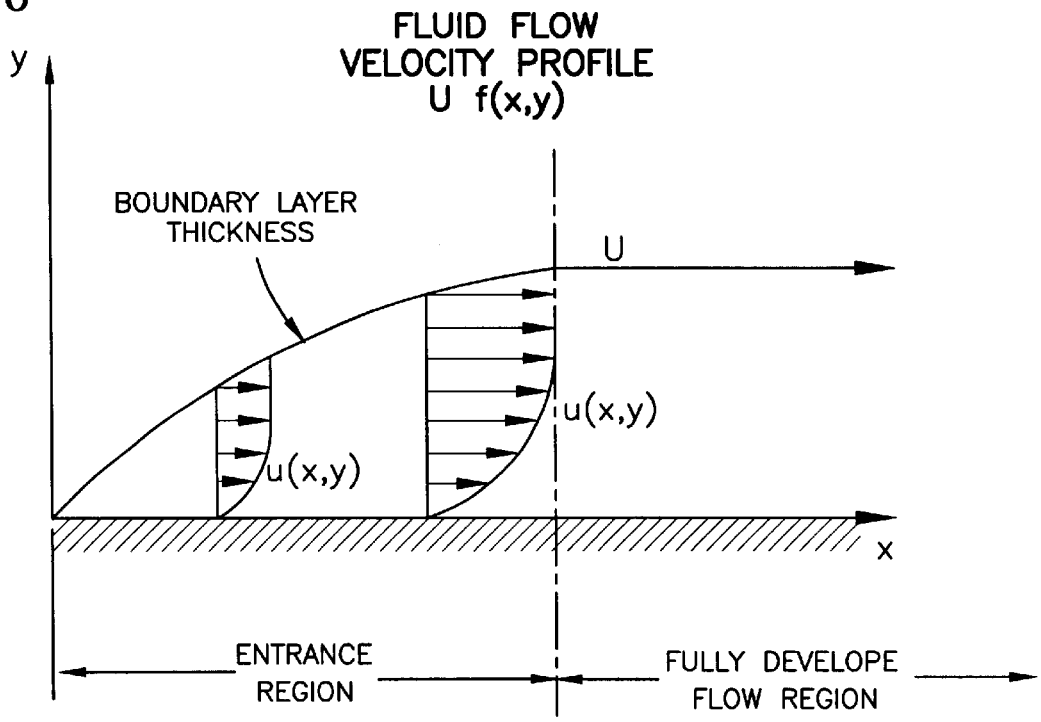
FIG. 6 is a fluid flow velocity profile chart illustrating a velocity profile having an entrance region followed by a fully developed region.

Referring to FIGS. 1 and 2, the present invention method and apparatus for cooling includes the use of cooling microcircuits 10 disposed within a wall 12 exposed to hot core gas within a gas turbine engine 11. Cooling air is typically disposed on one side of the wall 12 and hot core gas is disposed on the opposite side of the wall 12. Examples of a member which may utilize one or more present invention microcircuits 10 disposed within a wall 12 include, but are not limited to, combustors and combustor liners 14, blade outer air seals 16, turbine exhaust liners 18, augmentor liners 19, and nozzles 20. A preferred application for the present invention microcircuits 10 is within the wall of a turbine stator vane or rotor blade. FIG. 2 shows the microcircuits 10 disposed in the wall 12 of a turbine rotor blade 21. Referring to FIGS. 3–5, each microcircuit 10 includes a passage 22 consisting of a plurality of segments 24 interconnected by turns 26. In all embodiments, an inlet aperture 28 connects one end of the first passage segment 30 to the cooling air and an exit aperture 32 connects one end of the last passage segment 34 to the exterior of the wall 12. In most applications, the passage 22 will be planar; i.e., a substantially constant distance from the interior and exterior surfaces of the wall 12.

The cooling microcircuit 10 embodiments can occupy a wall surface area as great as 0.1 square inches (64.5 $mm^2$). It is more common, however, for a microcircuit 10 to occupy a wall surface area less than 0.06 square inches (38.7 $mm^2$), and the wall surface of preferred embodiments typically occupy a wall surface area closer to 0.01 square inches (6.45 $mm^2$). Passage size will vary depending upon the application, but in most embodiments the cross-sectional area of the passage segment is less than 0.001 square inches (0.6 $mm^2$). The most preferred passage 22 embodiments have a cross-sectional area between 0.0001 and 0.0006 square inches (0.064 $mm^2$ and 0.403 $mM^2$) with a substantially rectangular shape. The larger perimeter of a substantially rectangular shape provides advantageous cooling. For purposes of this disclosure, the passage 22 cross-sectional area shall be defined as a cross-section taken along a plane perpendicular to the direction of cooling airflow through the passage 22.

In all embodiments, the length of each passage segment 24 is limited to increase the average heat transfer coefficient per unit flow within the segment 24. A particular passage segment 24 within a microcircuit 10 can have a length over hydraulic diameter ratio (L/D) as large as twenty. A typical passage segment 24 in most present microcircuits, however, has an L/D ratio between ten and six approximately, and the most preferable L/D for the longest passage segment 24 is seven. As will be described in detail below, the length of passage segments 24 in any particular microcircuit 10 embodiment can vary, including embodiments where the segment lengths get successively shorter. The cumulative length of the passage 22 depends on the application. Applications where the pressure drop across the wall 12 is greater can typically accommodate a greater passage 22 length; i.e., a greater number of passage segments 24 and turns 26.

Under typical operating conditions within the turbine section of a gas turbine engine 11, the cooling air Mach number within the a microcircuit passage 22 will likely be in the vicinity 0.3. With a Mach number in that vicinity, the entrance region within a typical passage segment 24 of a microcircuit 10 will likely extend somewhere between five and fifty diameters (diameter=the passage hydraulic diameter). Obviously, the length of the passage segment 24 will dictate what segment length percentage is characterized by velocity profile entrance region effects; i.e., successively shorter passage segments 24 will have an increased percentage of each segment length characterized by velocity profile entrance effects. At a minimum, however, passage segments 24 within the present microcircuit will at least fifty percentage of its length devoted to entrance region effects, and more typically at least eighty percent. The following embodiments are offered as examples of the present invention microcircuit. The present invention includes, but is not limited to, the examples described below.

FIG. 3 shows an embodiment of the present invention microcircuit 10 which includes "n" number of equal length passage segments 24 connected by "n−1" number of turns 26 in a configuration that extends back and forth, where "n" is an integer. FIG. 4 shows another embodiment of the present invention microcircuit 10 that includes "n" number of passage segments 24 connected by "n−1" turns 26 in a configuration that extends back and forth. Each successive passage segment 24 is shorter in length than the segment 24 before. FIG. 5 shows another microcircuit 10 embodiment that includes "n" number of passage segments 24 connected by "n−1" turns 26 in a configuration that spirals inwardly. A number of the passage segments 24 in this embodiment are equal in length and the remaining passage segments 24 are successively shorter.

For any given set of operating conditions, each of the above described microcircuit 10 embodiments will provide a particular heat transfer performance. It may be advantageous, therefore, to use more than one type of the present invention microcircuits 10 in those applications where the thermal profile of the wall to be cooled is non-uniform. The microcircuits 10 can be distributed to match and offset the non-uniform thermal profile of the wall 12 and thereby increasing the cooling effectiveness of the wall 12.

Although this invention has been shown and described with respect to the detailed embodiments thereof, it will be understood by those skilled in the art that various changes in form and detail thereof may be made without departing from the spirit and the scope of the invention.

What is claimed is:

1. An airfoil, comprising:

an internal cavity;

an external wall;

at least one cooling air passage disposed in said external wall, said passage having a plurality of segments connected in series by at least one turn, wherein said passage segments each have a length over diameter ratio equal to or less than 20;

wherein one of said passage segments includes an inlet aperture connecting said passage to said internal cavity, and another of said passage segments includes an exit aperture connecting said passage to a region outside said airfoil; and wherein cooling air within said internal cavity may enter said passage through said inlet aperture and exit said passage through said exit aperture.

2. The airfoil of to claim 1, wherein said length over diameter ratio of each said passage segment is in the range between and including 10 and 6.

3. The airfoil of claim 2, wherein said length over diameter ratio of each said passage segment is approximately equal to 7.

4. The airfoil of claim 1, wherein said cooling air passage occupies a wall surface area no greater than 0.1 square inches.

5. The airfoil of claim 4, wherein said cooling air passage occupies a wall surface area no greater than 0.06 square inches.

6. The airfoil of claim 5, wherein said cooling air passage occupies a wall surface area no greater than 0.01 square inches.

7. The airfoil of claim 1, wherein each said passage segment has a cross-sectional area no greater than 0.001 square inches.

8. The airfoil of claim 7, wherein each said passage segment has a cross-sectional area no greater than 0.0006 square inches and no less than 0.0001 square inches.

9. The airfoil of claim 1, wherein said successive passage segments are successively shorter in length.

10. The airfoil of claim 1, wherein said passage segments spiral inwardly.

11. An airfoil for use in a gas turbine engine, wherein said airfoil is coolable by cooling air and is operable under operating conditions within said gas turbine engine, said coolable airfoil comprising:

an internal cavity;

an external wall;

at least one cooling air passage disposed in said external wall, said passage having a plurality of segments connected in series by at least one turn, wherein at least one of said passage segments includes an inlet aperture connecting said passage to said internal cavity, and another of said passage segments includes an exit aperture connecting said passage to a region outside said airfoil; and wherein each said passage segment has a length, and said length is limited such that and at least fifty percent of said length is subject to a cooling air velocity profile which includes entrance effects when said airfoil is operated under said operating conditions.

12. The airfoil of claim 11, wherein said length of each said passage is limited such that and at least eighty percent of said length is subject to a cooling air velocity profile which includes entrance effects when said airfoil is operated under said operating conditions.

13. A coolable wall, comprising:

a first external surface;

a second external surface; and at least one cooling air passage disposed in said wall between said first and second external surfaces, said passage having a plurality of segments connected in series by at least one turn, wherein each said passage segment has a length over diameter ratio equal to or less than 20;

wherein a single one of said passage segments includes an inlet aperture extending between said passage and said first external surface at an upstream end of said passage, and a single other of said passage segments includes an exit aperture extending between said passage and said second external surface at a downstream end of said passage; and wherein cooling air can enter said passage through said inlet aperture and exit said passage through said exit aperture.

14. The airfoil of claim 13, wherein said successive passage segments are successively shorter in length.

15. The coolable wall of claim 13, wherein said passage segments spiral inwardly.

16. A wall for use in an apparatus within a gas turbine engine, wherein said wall is coolable by cooling air and said apparatus is operable under operating conditions within said gas turbine engine, said coolable wall comprising:

an internal surface exposed to said cooling air;

an external surface exposed to core gas; and at least one cooling air passage disposed in said wall between said internal and external surfaces, said passage having a plurality of segments connected in series by at least one turn, wherein one of said passage segments includes an inlet aperture extending between said passage and said internal surface, and another of said passage segments includes an exit aperture extending between said passage and said external surface; and wherein each said passage segment has a length, and said length is limited such that and at least fifty percent of said length is subject to a cooling air velocity profile which includes entrance effects when said airfoil is operated under said operating conditions.

17. The wall of claim 16, wherein said length of each said passage is limited such that and at least eighty percent of said length is subject to a cooling air velocity profile which includes entrance effects when said airfoil is operated under said operating conditions.

18. A method for cooling a wall within a gas turbine engine, comprising the steps of:

providing a wall having an first surface and a second surface, wherein a source of cooling air is contiguous with said first surface and a source of core gas is contiguous with said second surface;

providing a set of operating conditions for said gas turbine engine;

providing a passage disposed within said wall between said first and second surfaces, said passage including a plurality of segments connected to one another by at least one turn, wherein an inlet aperture extends between one of said segments and said first surface, and an exit aperture extends between another of said segments and said second surface, and wherein each of said segments has a length;

sizing said length of each said segment such that under said operating conditions cooling air passing through any of said passage segments will have a velocity profile with entrance region effect characteristics for at least fifty percent of said length.

19. A method for cooling a wall within a gas turbine engine, comprising the steps of:

providing a wall having an first surface and a second surface, wherein a source of cooling air is contiguous with said first surface and a source of core gas is contiguous with said second surface;

providing a set of operating conditions for said gas turbine engine;

providing a passage disposed within said wall between said first and second surfaces, said passage including a plurality of segments connected to one another by at least one turn, wherein an inlet aperture extends between one of said segments and said first surface, and an exit aperture extends between another of said segments and said second surface, and wherein each of said segments has a length;

sizing said lengths of said passage segments such that all of said passage segments have a length over diameter ratio equal to or less than 20.

20. The method of claim 19, further comprising the step of:

selectively decreasing said length of successive said segments and thereby positively influencing heat transfer between said wall and said cooling air within said passage.

21. The method of claim 20, wherein said segments are selectively decreased in length beginning with an initial segment and ending with a final segment.

22. The method of claim 19, wherein said passage segments spiral inwardly.

23. A method for cooling a wall within a gas turbine engine, said method comprising the steps of:

providing a wall having a first surface and a second surface, wherein cooling air is contiguous with said first surface and core gas is contiguous with said second surface;

providing a plurality of passages within said wall, each said passage including a plurality of segments connected to one another by at least one turn, wherein a first aperture extends between one of said segments and said first surface, and a second aperture extends between another of said segments and said second surface;

determining an expected thermal load under a predetermined set of operating conditions in each of a plurality of regions along said wall;

selectively tuning each said passage to provide a particular amount of heat transfer performance for said set of operating conditions; and positioning said passages in said regions such that said heat transfer performance of said passages substantially equals said expected thermal load in said region.

24. A method for cooling a wall within a gas turbine engine, comprising the steps of:

providing a wall having an first surface and a second surface, wherein a source of cooling air is contiguous with said first surface and a source of core gas is contiguous with said second surface;

providing a passage disposed within said wall between said first and second surfaces, said passage including a plurality of segments connected to one another in series by at least one turn, wherein an inlet aperture extends between one of said segments and said first surface, and an exit aperture extends between another of said segments and said second surface;

providing a set of operating conditions for said gas turbine engine, said operating conditions including a pressure difference across said wall, and a core gas pressure value adjacent said exit aperture;

determining a desired difference in pressure across said exit aperture;

determining a cooling gas pressure inside said passage adjacent said exit aperture using said desired difference in pressure across said exit aperture;

determining a desired pressure difference across said plurality of segments using said pressure difference across said wall and said cooling gas pressure inside said passage adjacent said exit aperture; and sizing said inlet aperture to provide said desired pressure difference across said plurality of segments.

* * * * *